US008794987B2

(12) United States Patent
Classen et al.

(10) Patent No.: US 8,794,987 B2
(45) Date of Patent: Aug. 5, 2014

(54) CONNECTOR DEVICE FOR PRODUCING AN ELECTRICAL CONNECTION BETWEEN A MAINS CABLE AND A LOOM

(75) Inventors: Egbert Classen, Wertingen (DE); Hans-Dieter Roβteuscher, Giengen (DE); Roland Ertle, Lauingen (DE); Erika Ulrike Ertle, legal representative, Lauingen (DE); Marion Ertle, legal representative, Lauingen (DE); Lisa Marie Ertle, legal representative, Lauingen (DE); Marco Andreas Ertle, legal representative, Lauingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1787 days.

(21) Appl. No.: 10/583,637

(22) PCT Filed: Dec. 14, 2004

(86) PCT No.: PCT/EP2004/053445

§ 371 (c)(1),
(2), (4) Date: Aug. 3, 2007

(87) PCT Pub. No.: WO2005/064751

PCT Pub. Date: Jul. 14, 2005

(65) Prior Publication Data

US 2008/0227318 A1 Sep. 18, 2008

(30) Foreign Application Priority Data

Dec. 23, 2003 (DE) ..... 103 60 904
Apr. 21, 2004 (DE) ..... 10 2004 019 349

(51) Int. Cl.

| | |
|---|---|
| ***H01R 29/00*** | (2006.01) |
| ***H01R 13/52*** | (2006.01) |
| *H01R 24/70* | (2011.01) |
| *H01R 13/652* | (2006.01) |
| *H01R 13/719* | (2011.01) |
| *H01R 103/00* | (2006.01) |
| *H01R 31/06* | (2006.01) |

(52) U.S. Cl.

CPC ..... *H01R 13/5219* (2013.01); *H01R 24/70* (2013.01); *H01R 13/652* (2013.01); *H01R 13/719* (2013.01); *H01R 2103/00* (2013.01); *H01R 31/06* (2013.01)

USPC ..... 439/189; 439/638

(58) Field of Classification Search

USPC ..... 439/638, 620

See application file for complete search history.

(56) References Cited

U.S. PATENT DOCUMENTS 3,015,687 A 1/1962 Ruscito
4,259,705 A * 3/1981 Stifter ..... 361/56

(Continued)

FOREIGN PATENT DOCUMENTS

| | | |
|---|---|---|
| DE | 83 28 188 U | 12/1983 |
| DE | 91 05 135 U | 6/1991 |
| DE | 196 08 245 | 9/1997 |
| EP | 1 182 734 | 2/2002 |
| WO | WO 03/100940 | 12/2003 |

OTHER PUBLICATIONS

International Search Report PCT/EP2004/053445.

*Primary Examiner* — Briggitte R Hammond
(74) *Attorney, Agent, or Firm* — James E. Howard; Andre Pallapies

(57) ABSTRACT

A connector device for the production of an electrical connection between a mains cable and a cable harness in an electrical device, in particular, a domestic device, is disclosed, comprising a first plug-in connector, for the production of a detachable, mechanical and electrical connection to the cable harness of the electrical device and a second plug-in connector, for the production of a detachable, mechanical and electrical connection to the mains cable, whereby the second plug-in connector is provided for a number of differing mains cables and has an identical connector configuration for each of the differing mains cables.

8 Claims, 3 Drawing Sheets

(56) References Cited

U.S. PATENT DOCUMENTS

Figure 1:
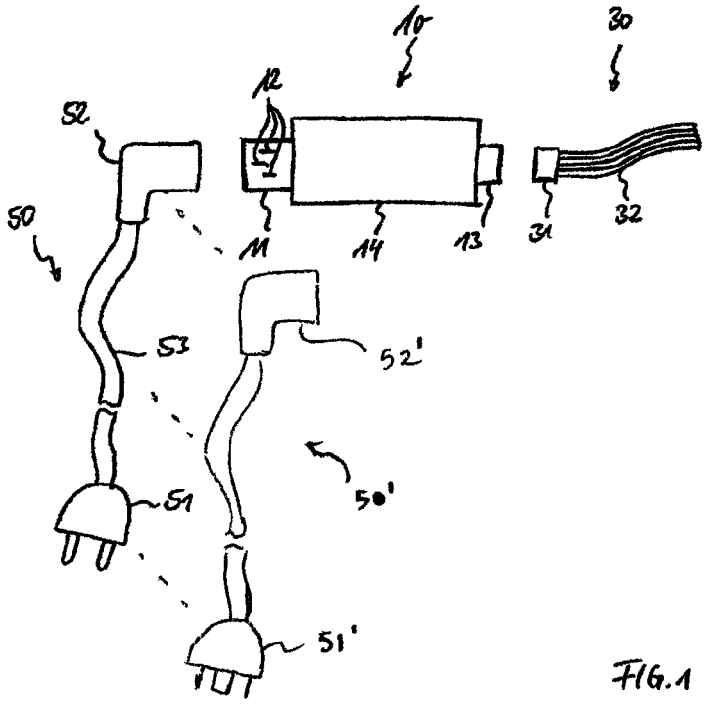

| | | | | |
|---|---|---|---|---|
| 5,518,418 | A | 5/1996 | Larabell | |
| 6,268,561 | B1 | 7/2001 | Buscella | |
| 6,309,248 | B1 | 10/2001 | King | |
| 6,321,340 | B1 * | 11/2001 | Shin et al. | 439/638 |
| 6,764,321 | B2 * | 7/2004 | Machado | 439/105 |
| 2002/0042223 | A1 | 4/2002 | Belopolsky et al. | |
| 2003/0190844 | A1 * | 10/2003 | Foux | 439/638 |
| 2004/0005818 | A1 * | 1/2004 | Judge et al. | 439/638 |
| 2006/0194467 | A1 * | 8/2006 | Beasley et al. | 439/339 |

* cited by examiner

CONNECTOR DEVICE FOR PRODUCING AN ELECTRICAL CONNECTION BETWEEN A MAINS CABLE AND A LOOM

The application relates to a connector device for the production of an electrical connection between a mains cable and a cable harness as well as a connection system.

Electrical appliances such as, for example, dishwashers, washing machines or laundry driers and the like are supplied in many different countries. Some of these countries have different power supply networks with regard to mains frequency or voltage and require mains contact plugs specific to the country for the electrical connection of the appliance by means of a mains cable. For a manufacturer of these appliances, the difficulty therefore arises that the electrical appliances must be provided in a plurality of variants for different countries.

At the present time, a connector device known as a "mains connecting socket" is used for the electrical connection to the power supply. At one of its front sides this socket is firmly connected to a mains cable whose electrical conductors are crimped or welded to corresponding contacts of the connector device inside the mains connecting socket. The mains connecting socket also has a plurality of contact blades which are used for electrical connection to a cable harness of the electrical appliance. The electrical connection between the mains connecting socket and the cable harness is made by means of single tab connectors. This process is carried out manually by a person at the manufacturer's works.

The housing of the mains connecting socket is prepared such that a radio interference suppression filter can be incorporated and inserted therein. Depending on the embodiment, the radio interference suppression filter has a resistor and/or a charge storage device connected in parallel and/or other elements. In appliances with speed-regulated motors, an inductance is additionally arranged in a series circuit with the radio interference suppression filter. The inductance is also connected manually using single tab connectors where the inductance is not arranged inside the mains connecting socket but is connected between the mains connecting socket and the cable harness. Together with the interference suppression filter the inductance forms an LC oscillator circuit.

This procedure for making a mains connection which has been used for many years has several disadvantages. Firstly, the manufacture and installation of the mains connection involves numerous manual working steps. In addition to the high manufacturing costs, as a result of the manual work, there is a risk of miscontacts or poor contact connections since a plurality of single plugs must be connected together. On the other hand, as a result of the inseparable unit of mains cable and mains connecting socket, a plurality of different variants need to be provided for manufacture, depending on the country to which the appliance is to be supplied.

It is thus the object of the present invention to produce a mains connections for electrical appliances, especially household appliances such as, for example, dishwashers, washing machines, laundry driers etc. which can be implemented substantially more simply and therefore more cost-effectively compared with the procedure described.

The connector device according to the invention for the production of an electrical connection between a mains cable and a cable harness in an electrical device comprises a first plug-in connector for the production of a detachable mechanical and electrical connection to the cable harness of the electrical device, and a second plug-in connector for the production of a detachable mechanical and electrical connection to the mains cable, wherein the second plug-in connector is provided for a plurality of different mains cables and has an identical connector configuration for each of the different mains cables.

The connection system comprises a connector device according to the invention, comprising a mains cable whose corresponding connector contact plug has an identical configuration regardless of the design of the mains contact plug and comprising a cable harness whose plurality of electrical conductors can be connected to the connector device by means of a single plug-in contact connection.

In other words, the invention proposes that the hitherto existing unit of mains cable and mains connecting socket should be separated and contact between these two components should be made by means of a plug-in connector. This procedure has the advantage that regardless of the country for which the electrical appliance is intended, standard connecting sockets can be used. This simplifies manufacture and considerably reduces the manufacturing complexity. Electrical appliances can then be supplied with country-specific mains cable, which have mains contact plugs suitable for the respective power supply. However, the connector contact plug provided for contact with the connector device always has the same design.

It is further proposed that instead of using single contact plugs which necessitate a corresponding number of contacting processes, a single plug-in connector should be used. This can be configured in the form of a group plug in which a plurality of contact elements are formed.

A particular advantage is obtained when testing the electrical appliance in the course of functional and/or quality testing. As a result of the plug-in connector now provided which is intended for connection to the mains cable, fully automatic contacting can take place during manufacture for any functional defects. Merely a single plug-in contact configuration of the test installation is required for this purpose. In contrast, it was previously necessary to provide a plurality of plug-in contacts in the test device since electrical contact to the electrical appliance could only be made via the mains cable already provided each having different mains contact plugs for different countries.

The connector device according to the invention is preferably used in dishwashers, washing machines or laundry driers. All these appliances are water-bearing. It is therefore advantageous if at least the second plug-in connector is configured such that after plugging together with the connector contact plug of the mains cable, this is protected from penetration of dripping or splashed water. This can be achieved for example if the connector contact plug of the mains cable needs to be inserted into the second plug-in connected by means of a press fit. Additionally or alternatively, a sealing lip or a sealing bead can be provided either on the connector contact plug or on the second plug-in connector.

In a further advantageous embodiment, the connector device comprises an interference suppression filter, the housing of the connector device being constructed to detachably receive the interference suppression filter. The detachable receiver is advantageously formed by at least one plug connection constructed in the housing. It is especially advantageous if the plug connection forms a plug contact which takes over the electrical contacting of the interference suppression filter in addition to the mechanical holding thereof. The invention also proposes using plug-in connectors located in or on the housing for connecting an interference suppression filter. In contrast to the use of crimp plug connectors which must each be connected by a manual connection process, these plug-in connections can be produced automatically. The term "plug-in contact" should thus be interpreted such that this has a plurality of contact elements which can be contacted jointly by means of a plug-in process. Dispensing with single plug-in connections or crimp plug connectors allows more rapid and more reliable contact between the interference suppression filter and the connector device.

The interference suppression filter can optionally have a charge storage device and/or an inductance and/or a resistance and/or other elements. While the charge storage device and any resistance provided are incorporated in parallel in the circuit, the inductance is connected in series. For this purpose, it is advantageous if the connector device has conductor tracks for producing a direct electrical connection between the mains cable and the cable harness which can be separated by means of a separating device for breaking the electrical connection. The separating device can be a switching element, a mechanically actuated plug-in connection or a fuse to be destroyed during the manufacturing process. If the interference suppression filter is provided with an inductance, care must be taken to ensure that this is not short-circuited by the conductor tracks provided in the connector device. The separating device prevents such a short-circuit in the case of an interference filter with an inductance.

Figure 2:
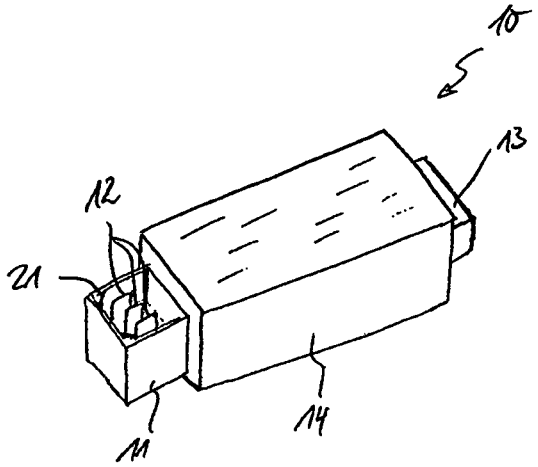
Figure 3:
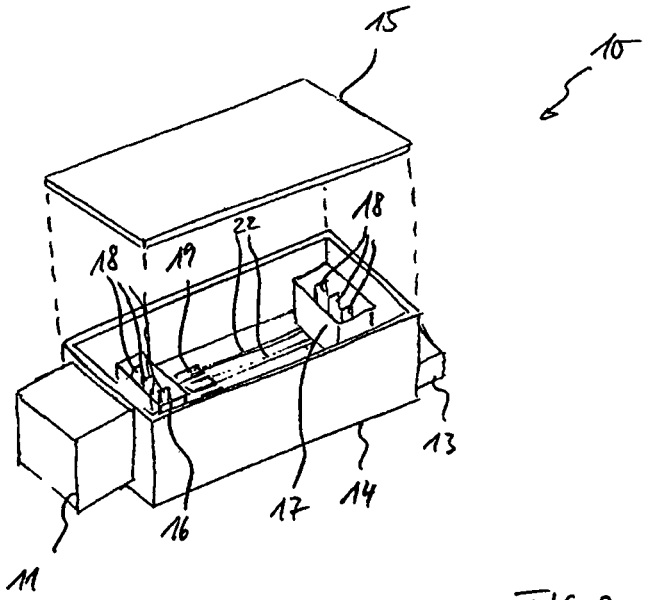
Figure 4:
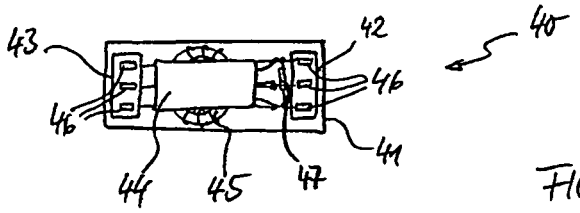
Figure 5:
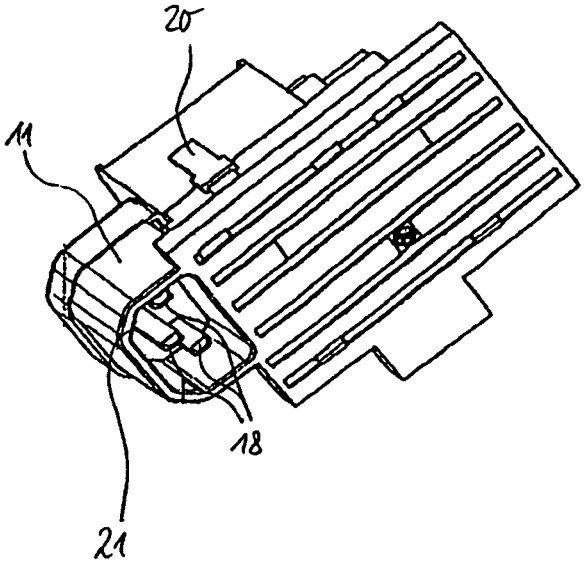

The invention and its advantages are explained hereinafter with reference to the figures. In the figures:

FIG. 1 is a connection system according to the invention comprising a mains cable, a connector device and a cable harness, FIG. 2 is an exemplary embodiment of a connector device according to the invention in a perspective view, FIG. 3 is another perspective view of the first exemplary embodiment of the connector device which shows a possibility for contact for an optional interference suppression filter, FIG. 4 shows an exemplary schematic structure of an interference suppression filter and FIG. 5 shows another exemplary embodiment in a perspective view of the connector device according to the invention.

The principle of the connection system according to the invention for the production of an electrical connection between a mains cable and a cable harness in an electrical device can be seen from FIG. 1. The connection system consists of a connector device 10, a mains cable 50, 50' and a cable harness 30. The connector device 10 comprises a first plug-in connector 13 and a second plug-in connector 11. The plug-in connectors 11, 13 are constructed on, or alternatively in, a housing 14 of the connector device 10. The second plug-in connector 11 is configured in the form of a contact cup moulded on the housing 14. Three contacts 12 are formed therein.

The connector contact plug 52, 52' is constructed so that it corresponds to the second plug-in connector 11 so that this can be inserted in the contact cup of the connector device 10 by means of a press fit, for example. The connector contact plug 52, 52' is connected to a country-specific mains contact plug 51, 51' via a cable 53. The mains contact plug 51, 51' is constructed according to the particular requirements of the country. The connector contact plug 52, 52' on the other hand has a fundamentally identical configuration for any mains cable.

The cable harness 30 consists of a cable harness contact plug 31 which is constructed so that it corresponds to the first plug-in connector 13. Provided therein are a plurality of individual leads which, for example, in addition to leads for the power supply of the electrical appliance, can also comprise leads for transmitting control signals which are combined to form a cable and connected to the cable harness contact plug.

Regardless of the country in which the electrical appliance is to be supplied, the connector device 10 and the cable harness 30 are always constructed identically. This particularly applies to the configuration and arrangement of the first and second plug-in connectors 11, 13. The combining of a plurality of electrical leads in a cable harness and their electrical contacting in a cable harness contact plug allows the electrical connection with the connector device to be made by means of a single plug-in process. This takes over the mechanical and electrical connection of the connector device with the cable harness. The connection can be made, for example, by means of a click-stop closure which allows the two components to be intentionally detached from one another but prevents unintentional detachment.

The same applies to the second plug-in connector 11 of the connector device 10 with the mains cable 50. This connection can also be separated again by pulling out the connector contact plug 52 from the second plug-in connector.

The first plug-in connector can be embodied as a so-called group connector e.g. in "Rast 5" design which allows the connection to the cable harness of the electrical appliance to be made simply, free from error and rapidly. The designation "Rast 5" means that respective contact elements of the cable harness contact plug are arranged at a distance of 5 mm from one another. In principle, any arbitrary distance can be selected.

FIG. 2 shows a connector device according to the invention in a first embodiment in a perspective view. The first and the second plug-in connectors 13, 11 are each disposed on the front sides of the housing 14. The second plug-in connector 11 has encodings 21 in the form of moulded-on housing material which prevents incorrect connection of the mains cable. The mains cable is inserted into the second plug-in connector 11 for example from the top of the connector device 10. This can then be connected with its underside mechanically securely to the housing or an element of the electrical appliance provided for this purpose, e.g. by means of locating hooks or another connection. The first plug-in connector 13 can be connected to the cable harness, for example, from the top. The arrangement of the first and the second plug-in connectors with regard to the housing can in principle be freely selected.

FIG. 3 shows the connector device according to the invention from FIG. 2 from the underside, where a cover 15 is lifted from the housing 14. Two plug-in connections 16, 17 can now be seen, these being used to make mechanical and electrical contact with an interference suppression filter which can be inserted in the housing 14, as shown in FIG. 4 for example. FIG. 3 also shows conductor tracks 22 running inside the housing 14 which make electrical contact between the contact elements 12 of the second plug-in connector and contact elements of the first plug-in connector 13. A separating device 19 is provided in a respective conductor track 22. This can be provided in the form of a separating fuse, for example. The electrical connection of the conductor tracks only needs to be separated if an interference suppression filter with a component to be connected in series, such as an inductance, for example, is incorporated in the connector device. This is necessary to ensure the series connection between the first and the second plug-in connectors without causing any short-circuit via the component. On the other hand, if merely an interference suppression filter with a component to be connected in parallel (e.g. a charge storage device and/or a discharging resistor) is incorporated, the conductor tracks 22 do not need to be separated. The configuration of the interference suppression filter with regard to its electronic components is in principle arbitrary and can especially vary from one country to another.

FIG. 4 shows a possible interference suppression filter 40 as an example. This comprises plug-in contacts 42, 43 matched to the plug-in connections 16, 17 with respective contact element receivers 45. An inductance 45 is arranged in series therebetween. Provided thereabove is a charge storage device 44 which is connected in parallel with a discharging resistor 47. The interference suppression filter shown is constructed as an LC oscillator circuit and can be integrated directly in the connector device 10. It is also feasible to provide an FI safety switch in the interference suppression filter or alternatively in the connector device.

FIG. 5 shows another exemplary embodiment of a connector device according to the invention. The perspective view shows an alternative arrangement of the contact elements 18 in the second plug-in connector 11 and the specific configuration of the encoding 21 to prevent any incorrect connection of the mains cable. The second plug-in connector 11 is embodied as a so-called primary power connection and thus is suitable for appliances which are used in damp surroundings. The reference numeral 20 indicates a locating device which can be used to reliably connect the housing to the housing cover. A locating connection can also be used to securely fix the connector device in the electrical appliance.

Reference List

10 Connector device
11 Plug-in connector
12 Contact
13 Plug-in connector
14 Housing
15 Cover
16 Plug-in contact receiver
17 Plug-in contact receiver
18 Contact
19 Separating device
20 Locating device
21 Encoding
22 Conductor track
30 Cable harness
31 Cable harness contact plug
32 Cable
40 Interference suppression filter
41 Housing
42 Plug-in contact
43 Plug-in contact
44 Charge storage device
45 Inductance
46 Contact receiver
47 Resistor
50 Mains cable
51 Mains contact plug
52 Connector contact plug
53 Cable

The invention claimed is:

1. A connection system comprising;

a plurality of different mains cables each having a differently configured mains contact; and a connector device for the production of an electrical connection between any of the plurality of mains cables and a cable harness in an electrical device, the connector device comprising a first plug-in connector including connection elements coupleable to the cable harness, the connection elements effecting a detachable mechanical and electrical connection to the cable harness of the electrical device, and a second plug-in connector establishing a detachable mechanical and electrical connection to any of the mains cables, wherein the second plug-in connector is provided for the plurality of different mains cables and has an identical connector configuration for each of the different mains cables, and wherein each of the plurality of mains cables has a corresponding connector contact plug with an identical configuration regardless of the design of the mains contact plug and comprising a cable harness whose plurality of electrical conductors can be connected to the connector device by means of a single plug-in contact connection.

2. A connector device for the production of an electrical connection between a mains cable and a cable harness in an electrical device, especially a household appliance, comprising a first plug-in connector for establishing a detachable mechanical and electrical connection to the cable harness of the electrical device, and a second plug-in connector for establishing a detachable mechanical and electrical connection to the mains cable, wherein the second plug-in connector is provided for a plurality of different mains cables and has an identical connector configuration for each of the different mains cables, wherein the connector device is configured to include an interference suppression filter and the housing of the connector device is constructed to detachably receive the interference suppression filter.

3. The connector device according to claim 2, wherein the detachable receiver is formed by at least one plug connection constructed in the housing.

4. The connector device according to claim 2, wherein the plug connection forms a plug contact which takes over the electrical contacting of the interference suppression filter in addition to the mechanical holding thereof.

5. The connector device according to claim 2, wherein the interference suppression filter has a charge storage device.

6. The connector device according to claim 2, wherein the interference suppression filter has an inductance.

7. The connector device according to claim 6, wherein conductor tracks for producing the electrical connection between the mains cable and the cable harness are provided therein which can be separated by means of a separating device for breaking the electrical connection.

8. The connector device according to claim 6, wherein the interference suppression filter has a discharging resistor.

* * * * *